US010909909B2

(12) United States Patent
Lee et al.

(10) Patent No.: US 10,909,909 B2
(45) Date of Patent: Feb. 2, 2021

(54) DISPLAY DEVICE AND DRIVING METHOD THEREOF

(71) Applicant: Samsung Display Co., Ltd., Yongin-si (KR)

(72) Inventors: Dong Eup Lee, Yongin-si (KR); Ki Myeong Eom, Yongin-si (KR); Ji Hyun Ka, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/440,863

(22) Filed: Jun. 13, 2019

(65) Prior Publication Data

US 2020/0175912 A1 Jun. 4, 2020

(30) Foreign Application Priority Data

Dec. 3, 2018 (KR) ..... 10-2018-0153583

(51) Int. Cl.

| | |
|---|---|
| ***G09G 3/32*** | (2016.01) |
| ***G09G 3/3266*** | (2016.01) |
| ***G09G 3/3275*** | (2016.01) |
| ***G09G 3/3225*** | (2016.01) |

(52) U.S. Cl.

CPC ..... *G09G 3/32* (2013.01); *G09G 3/3225* (2013.01); *G09G 3/3266* (2013.01); *G09G 3/3275* (2013.01); *G09G 2310/08* (2013.01); *G09G 2320/0247* (2013.01); *G09G 2330/021* (2013.01)

(58) Field of Classification Search

CPC ..... G09G 3/32; G09G 3/3225; G09G 3/3266; G09G 3/3275; G09G 2310/08; G09G 2320/0247; G09G 2330/021

See application file for complete search history.

(56) References Cited

U.S. PATENT DOCUMENTS

| | | | | |
|---|---|---|---|---|
| 8,509,155 | B2 | 8/2013 | Nam et al. | |
| 9,805,657 | B2 | 10/2017 | Kwon et al. | |
| 2014/0043314 | A1* | 2/2014 | Park | G09G 3/20 345/212 |

(Continued)

FOREIGN PATENT DOCUMENTS

| | | | |
|---|---|---|---|
| JP | 2006-243174 | A | 9/2006 |
| KR | 10-2015-0145368 | A | 12/2015 |

(Continued)

*Primary Examiner* — Stacy Khoo

(74) *Attorney, Agent, or Firm* — Lewis Roca Rothgerber Christie LLP

(57) ABSTRACT

A display device includes: a display panel including a gate line, an emission signal line, a data line, and a pixel coupled to the gate line, the emission signal line, and the data line; a gate driver configured to provide a gate signal to the gate line; an emission driver configured to provide an emission signal to the emission signal line; a data driver configured to provide a data signal to the data line; and a power supplier configured to provide the display panel with a power voltage for driving the pixel, wherein the emission driver is configured to start operating at a first time point in response to an emission enable signal provided from the data driver, and the gate driver is configured to start operating at a second time point in response to a gate enable signal provided from the data driver.

20 Claims, 16 Drawing Sheets

(56) References Cited

U.S. PATENT DOCUMENTS

| | | | | |
|---|---|---|---|---|
| 2015/0371601 | A1 | 12/2015 | Kim | |
| 2018/0226029 | A1* | 8/2018 | Park | G09G 3/3266 |
| 2019/0180709 | A1 | 6/2019 | Lee et al. | |

FOREIGN PATENT DOCUMENTS

| | | | |
|---|---|---|---|
| KR | 10-2016-0007847 | A | 1/2016 |
| KR | 10-1869278 | B1 | 6/2018 |
| KR | 10-2019-0070379 | A | 6/2019 |

* cited by examiner

DISPLAY DEVICE AND DRIVING METHOD THEREOF

CROSS-REFERENCE TO RELATED APPLICATION

This application claims priority to and the benefit of Korean patent application 10-2018-0153583 filed on Dec. 3, 2018 in the Korean Intellectual Property Office, the entire disclosure of which is incorporated herein by reference.

BACKGROUND

1. Field

Aspects of some example embodiments of the present disclosure generally relate to a display device and a driving method thereof.

2. Related Art

A display device displays an image in a display panel, using control signals applied from the outside. The display device includes the display panel having a plurality of pixels arranged in a matrix form, a display panel driving circuit, and a power supply circuit.

The Background section of the present Specification includes information that is intended to provide context to example embodiments, and the information in the present Background section does not necessarily constitute prior art.

SUMMARY

When an input voltage is supplied to the display device for the first time, that is, when the display device is initially driven, a transient current may be generated because components (e.g., a drive IC, a scan IC, and the like) in the display device are simultaneously driven, and interference between the components and deterioration of display quality (e.g., screen flicker) due to the interference may occur.

Aspects of some example embodiments include a display device capable of preventing or reducing deterioration of display quality when the display device is initially driven, and a driving method of the display device.

According to some example embodiments of the present disclosure, a display device includes: a display panel including a gate line, an emission signal line, a data line, and a pixel coupled to the gate line, the emission signal line, and the data line; a gate driver configured to provide a gate signal to the gate line; an emission driver configured to provide an emission signal to the emission signal line; a data driver configured to provide a data signal to the data line; and a power supplier configured to provide the display panel with a power voltage for driving the pixel, wherein the emission driver starts operating at a first time point in response to an emission enable signal provided from the data driver, and the gate driver starts operating at a second time point in response to a gate enable signal provided from the data driver, wherein the second time point is later than the first time point.

The display panel may include a display area in which an image is displayed and a non-display area adjacent to an edge of the display area. The emission driver may be in the non-display area, and the gate driver may be located between the emission driver and the display area.

The display panel may further include a first power line and a second power line. The pixel may include: a first transistor including a first electrode coupled to a first node, a second electrode coupled to a second node, and a gate electrode coupled to a third node; a second transistor including a first electrode coupled to the data line, a second electrode coupled to the first node, and a gate electrode coupled to the gate line; a third transistor including a first electrode coupled to the second node, a second electrode coupled to the third node, and a gate electrode coupled to the gate line; a fourth transistor including a first electrode coupled to the first power line, a second electrode coupled to the first node, and a gate electrode coupled to the emission signal line; a capacitor coupled between the first power line and the third node; and a light emitting element coupled between the second node and the second power line.

The data driver may include: a register configured to store a first setting value defining the first time point and a second setting value defining the second time point; and a signal controller configured to generate the emission enable signal and the gate enable signal, based on the first setting value and the second setting value.

The power supplier may provide the power voltage to the display panel at a third time point in response to a power enable signal provided to the data driver. The third time point may be a time posterior to the first time point.

The data driver may provide the data line with a black data signal corresponding to a black image at the first time point and the second time point, and provide the data line with a valid data signal different from the black data signal at a fourth time point. The fourth time point may be later than the first to third time points.

The data driver may provide an emission start signal having a first voltage level to the emission driver in a first period between the first time point and the fourth time point, and periodically provide an emission start signal having a second voltage level in a second period after the fourth time point. The emission driver may provide the emission signal line with an emission signal having a waveform corresponding to a waveform of the emission start signal. The pixel may emit light with a luminance corresponding to the data signal in response to the emission signal.

The third time point may be later than the second time point.

A first sub-period between the first time point and the second time point may be longer than a second sub-period between the second time point and the third time point.

The first sub-period between the first time point and the second time point may have the same length as the second sub-period between the second time point and the third time point. A third sub-period between the third time point and the fourth time point may be longer than the first sub-period between the second time point and the third time point.

The second sub-period between the second time point and the third time point may be longer than the first sub-period between the first time point and the second time point.

The first sub-period between the first time point and the second time point, the second sub-period between the second time point and the third time point, and the third sub-period between the third time point and the fourth time point may have the same length.

The third time point may be the same as the second time point.

The first sub-period between the first time point and the second time point may be shorter than the third sub-period between the third time point and the fourth time point.

The first sub-period between the first time point and the second time point may have the same length as the third sub-period between the third time point and the fourth time point.

The first sub-period between the first time point and the second time point may be longer than the third sub-period between the third time point and the fourth time point.

The third time point may be between the first time point and the second time point.

According to some example embodiments of the present disclosure, in a method for driving a display device, the method includes: providing an emission signal having a first voltage level to a pixel in a display panel; providing a gate signal periodically having a second voltage level to the pixel by driving a gate driver; providing, by a data driver, a valid data signal to the display panel; and periodically changing, by the emission driver, the emission signal to have a second voltage level, and providing the emission signal having the second voltage level to the pixel.

The method may further include, before the providing of the valid data signal, providing, by a power supplier, a power voltage to the display panel.

The data driver may provide the display panel with a black data signal corresponding to a black image before the valid data signal is provided to the display panel.

The display device according to some example embodiments may minimize or reduce noise on the gate signal due to the light emission driver and can prevent or reduce deterioration of display quality such as blinking of a screen by driving the light emission driver earlier than the gate driver.

BRIEF DESCRIPTION OF THE DRAWINGS

Aspects of some example embodiments will now be described more fully hereinafter with reference to the accompanying drawings; however, they may be embodied in different forms and should not be construed as limited to the embodiments set forth herein. Rather, these example embodiments are provided so that this disclosure will be more thorough and more complete, and will more fully convey the scope of the example embodiments to those skilled in the art.

DETAILED DESCRIPTION

Figure 1:
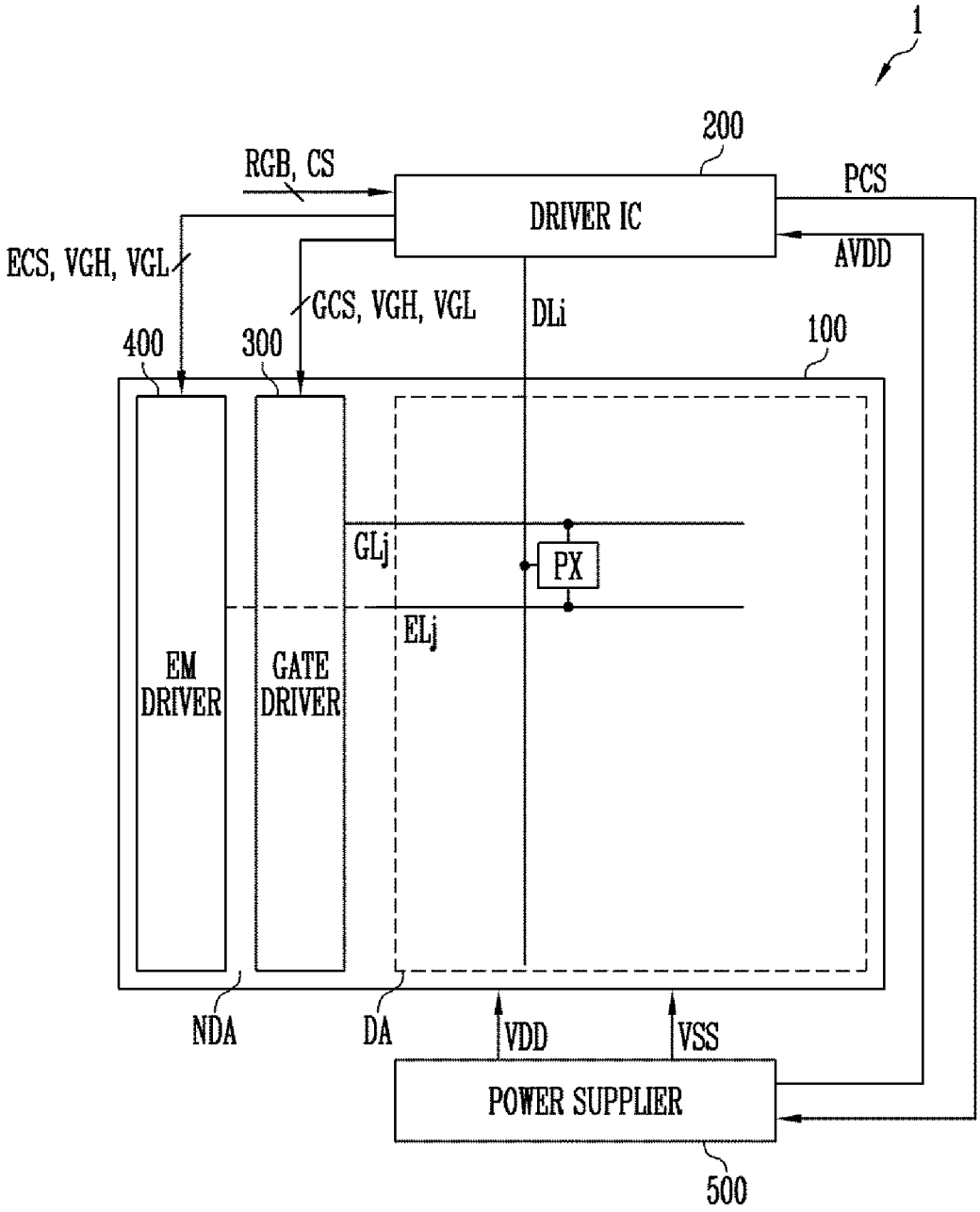
FIG. 1 is a diagram illustrating a display device according to some example embodiments of the present disclosure.

Hereinafter, aspects of some example embodiments are described in more detail with reference to the accompanying drawings so that those skilled in the art may more easily practice the present disclosure. The present disclosure may be implemented in various different forms and is not limited to the example embodiments described in the present specification.

Some parts or components irrelevant to the description will be omitted to more clearly describe the present disclosure, and the same or similar constituent elements will be designated by the same reference numerals throughout the specification. Therefore, the same reference numerals may be used in different drawings to identify the same or similar elements.

FIG. 1 is a diagram illustrating a display device according to some example embodiments of the present disclosure.

Referring to FIG. 1, the display device 1 may include a display panel 100, a driver IC (or drive IC) 200, a gate driver (or scan driver) 300, an emission driver (or emission control driver) 400, and a power supplier 500.

The display panel 100 may include a display area DA in which an image is displayed and a non-display area NDA in which the image is not displayed. The non-display area NDA may be located at one side of the display area DA or surround the display area DA, but the present disclosure is not limited thereto.

The display panel 100 may include a data line DLi (where, i is a positive integer), a gate line GLj (where, j is a positive integer), an emission line (or emission signal line) ELj (where, j is a positive integer), and a pixel PX. The pixel PX is arranged in the display area DA, and may be located in an area defined by the data line DLi, the gate line GLj, and the emission line ELj. The pixel PX may be coupled to the data line DLi, the gate line GLj, and the emission line ELj. The pixel PX may emit light with a luminance corresponding to a data signal provided through the data line DLi in response to a gate signal provided through the gate line GLj and an emission signal (or emission driving signal) provided through the emission line ELj. A detailed configuration and operation of the pixel PX will be described later with reference to FIG. 2.

The driver IC 200 may receive input image data RGB and a control signal CS from the outside (e.g., a graphic processor), and generate a gate control signal (or gate driving control signal) GCS, an emission control signal (or emission driving control signal) ECS, and a power control signal PCS, based on the control signal CS. The control signal CS may include a clock signal, a horizontal synchronization signal, a data enable signal, and the like. The gate control signal GCS is a signal for controlling an operation of the gate driver 300, and may include a gate enable signal (or gate driver enable signal), a start signal (or scan start signal), clock signals (or scan clock signals), and the like. The gate enable signal may be included in the start signal. Similarly, the emission control signal ECS is a signal for controlling an operation of the emission driver 400, and may include an emission enable signal (or emission driver enable signal), an emission start signal (or emission enable signal), emission clock signals, and the like. The power control signal PCS may include a power enable signal (or power supplier enable signal).

In some embodiments, the driver IC 200 may sequentially output the emission control signal (or emission enable signal) ECS, the gate driving signal (or gate enable signal) GCS, and the power control signal (or power enable signal) PCS when the driver IC 200 is initially driven (e.g., at a time point at which the display device 1 is turned on). The emission driver 400, the gate driver 300, and the power supplier 500 may be sequentially driven or sequentially start operations thereof in response to the emission control signal ECS, the gate driving signal GCS, and the power control signal PCS. When the display device 1 is initially driven, interference between an emission signal, a gate signal, and power voltages can be minimized, and malfunction of the pixel PX and deterioration of display quality (e.g., blinking of a screen), which are caused by the interference, can be prevented.

Also, the driver IC 200 may generate a data signal, based on the input image data RGB, and provide the data signal to the data line DLi.

In an embodiment, when the emission driver 400, the gate driver 300, and the power supplier 500 are initially driven, the driver IC 200 may generate a black data signal (i.e., a data signal corresponding to a black image, or an invalid data signal) and provide the black data signal to the display panel 100. Although interference may occur in the gate signal, the emission signal, etc., when the display device 1 is initially driven, the pixel PX can display a black image corresponding to the black data signal. Thus, an unintended image caused by the interference can be prevented from being viewed by a user.

When the emission driver 400, the gate driver 300, and the power supplier 500 are normally driven (e.g., after a certain time elapses when the emission driver 400, the gate driver 300, and the power supplier 500 are initially driven), the driver IC 200 may generate a valid data signal corresponding to the input image data RGB and provide the valid data signal to the display panel 100.

The driver IC 200 may receive an analog power voltage AVDD from the power supplier 500, and generate driving voltages VGH and VGL, using the analog power voltage AVDD. The driving voltages VGH and VGL are voltages at which transistors included in the gate driver 300, the emission driver 400, etc., are turned on or turned off, and a first driving voltage VGH may have a voltage level higher than that of a second driving voltage VGL.

The driver IC 200 may be coupled to the display panel 100 in the form of a Tape Carrier Package (TCP), or be formed on the non-display area NDA of the display panel 100.

The gate driver 300 may generate a gate signal, based on the gate control signal GCS, and provide the gate signal to the gate line GLj. For example, the gate driver 300 may start an operation thereof in response to the start signal (or gate enable signal), and sequentially generate and output a gate signal corresponding to the start signal, using the clock signals. The gate driver 300 may include a shift register. The gate driver 300 may be formed on the non-display area NDA of the display panel 100, but the present disclosure is not limited thereto. The gate driver 300 may be implemented with an IC, to be coupled to the display panel 100 in the form of a TCP.

The emission driver 400 may generate an emission signal, based on the emission control signal (or emission driving control signal) ECS, and provide the emission signal to the emission line ELj. For example, the emission driver 400 may start an operation thereof in response to the emission start signal (or emission enable signal), and sequentially generate and output an emission signal corresponding to the emission start signal, using the emission clock signals. The emission driver 400 may be formed on the non-display area NDA of the display panel 100, but the present disclosure is not limited thereto. The emission driver 400 may be implemented with an IC, to be coupled to the display panel 100 in the form of a TCP.

In some example embodiments, the emission driver 400 and the gate driver 300 are located in the non-display area NDA at one side of the display panel 100, and the gate driver 300 may be located between the emission driver 400 and the display area DA of the display panel 100. That is, the emission driver 400 may be located more adjacent to an edge of the display panel 100 than the gate driver 300. The gate driver 300 and the emission driver 400 are located at the same side of the display panel 100 so as to minimize the non-display area NDA of the display panel 100, and the gate driver 300 may be located more adjacent to the display panel 100 than the emission driver 400, by considering a pulse width of the gate signal, transfer characteristics of the gate signal, and the like.

The power supplier 500 may generate power voltages VDD and VSS in response to the power control signal (or power enable signal) PCS, and provide the power voltages VDD and VSS to the display panel 100. The power voltages VDD and VSS are voltages necessary for an operation of the pixel PX, and a first power voltage VDD may have a voltage level higher than that of a second power voltage VSS.

As described with reference to FIG. 1, when the display device 1 is initially driven, the driver IC 200 may sequentially generate and output the emission control signal ECS, the gate control signal GCS, and the power control signal PCS, and the emission driver 400, the gate driver 300, and the power supplier 500 may be sequentially driven in response to the emission control signal ECS, the gate control signal GCS, and the power control signal PCS. Thus, interference between the emission signal, the gate signal, and the power voltages can be minimized, and deterioration of display quality can be prevented.

Meanwhile, although a case where the gate driver 300 and the emission driver 400 are located at one side of the display panel 100 is illustrated in FIG. 1, the gate driver 300 and the emission driver 400 are not limited thereto. For example, the gate driver 300 may include first and second gate driving circuits, the emission driver 400 may include first and second emission driving circuits, the first gate driving circuit and the first emission driving circuit may be located at one side of the display panel 100 with respect to the area center of the display panel 100, and the second gate driving circuit and the second emission driving circuit may be located at the other side of the display panel 100 with respect to the area center of the display panel 100. The first and second emission driving circuits may be located more adjacent to an edge of the display panel 100 than the first and second gate driving circuits.

Figure 2:
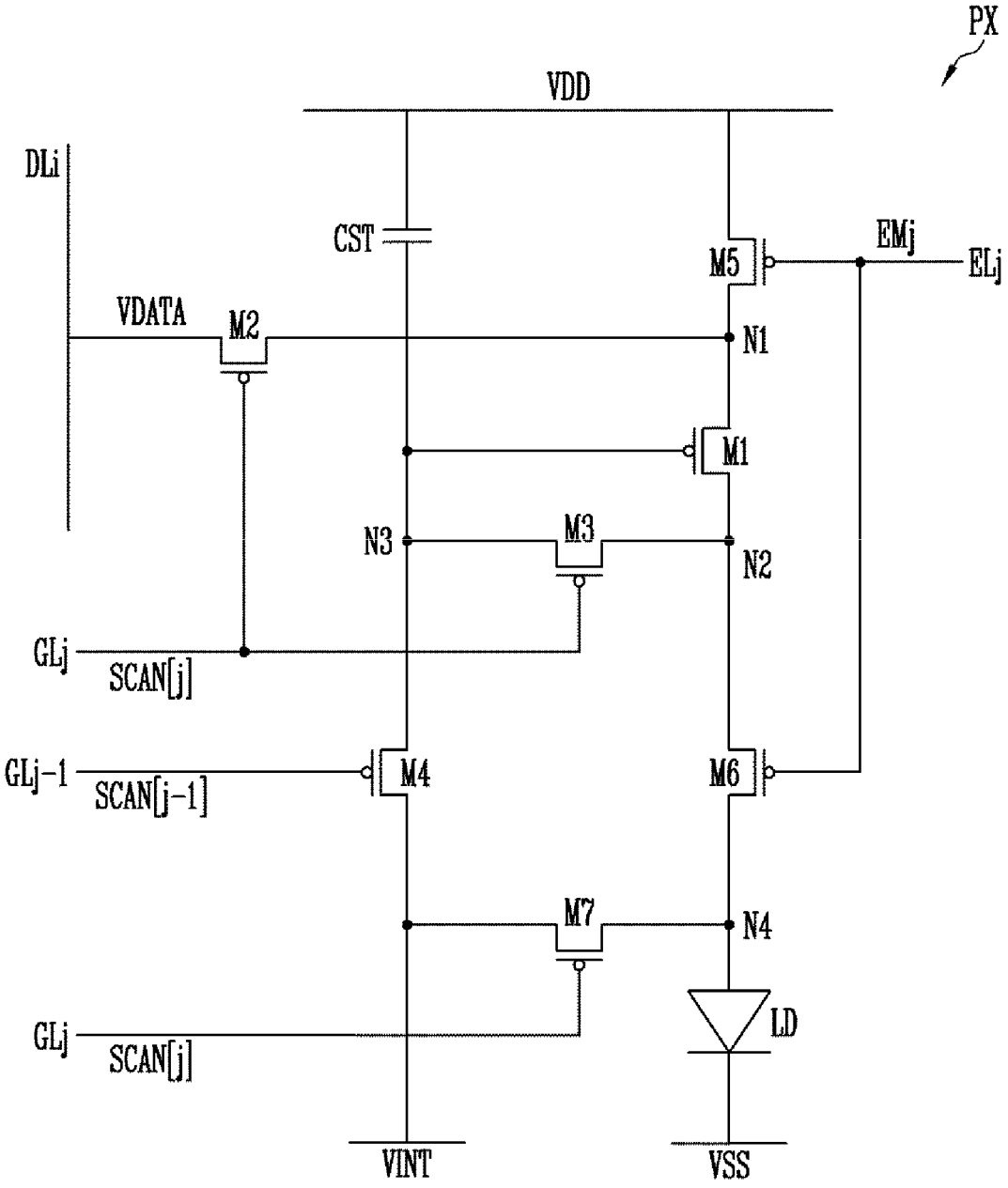
FIG. 2 is a circuit diagram illustrating an example of a pixel included in the display device shown in FIG. 1.

FIG. 2 is a circuit diagram illustrating an example of the pixel included in the display device shown in FIG. 1.

Referring to FIGS. 1 and 2, the pixel PX may include first to seventh transistors M1 to M7, a storage capacitor CST, and a light emitting diode (or a light emitting element) LD.

The first to seventh transistors M1 to M7 may be implemented with a P-type transistor (e.g., a PMOS transistor), but the present disclosure is not limited thereto. For example, at least some of the first to seventh transistors M1 to M7 may be implemented with an N-type transistor (e.g., an NMOS transistor).

The first transistor (or driving transistor) M1 may include a first electrode electrically coupled to a first node N1, a second electrode electrically coupled to a second node N2, and a gate electrode electrically coupled to a third node N3.

The second transistor M2 may include a first electrode coupled to a data line DLi, a second electrode coupled to the first node N1, and a gate electrode coupled to a gate line GLj. The second transistor M2 may be turned on in response to a gate signal SCAN[j] provided through the gate line GLj, and transfer a data signal VDATA provided through the data line DLi to the first node N1. For example, the gate signal SCAN[j] may be a pulse signal having a turn-on voltage level (or second driving voltage VGL) at which the transistor is turned on.

The third transistor M3 may include a first electrode coupled to the second node N2, a second electrode coupled to the third node N3, and a gate electrode coupled to the gate line GLj. The third transistor M3 may be turned on in response to the gate signal SCAN[j], and transfer the data signal VDATA transferred through the first transistor M1 from the first node N1 to the third node N3.

The storage capacitor CST may be coupled between a first power voltage line and the third node N3. A first power voltage VDD may be applied to the first power voltage line. The storage capacitor CST may store the data signal VDATA transferred to the third node N3.

The fourth transistor M4 may include a first electrode coupled to the third node N3, a second electrode coupled to an initialization voltage line, and a gate electrode adjacent to a previous gate line GLj−1. The previous gate line GLj−1 may be a gate line located adjacent to the gate line GLj. The fourth transistor M4 may be turned on in response to a previous gate signal SCAN[j−1] provided through the previous gate line GLj−1, and initialize the third node N3, using an initialization voltage VINT provided through the initialization voltage line. That is, a node voltage (or data signal VDATA stored in the storage capacitor CST in a previous frame) of the third node N3 may be initialized to the initialization voltage VINT.

The fifth transistor M5 may include a first electrode coupled to the first power voltage line, a second electrode coupled to the first node N1, and a gate electrode coupled to an emission line ELj. Similarly, the sixth transistor M6 may include a first electrode coupled to the second node N2, a second electrode coupled to a fourth node N4, and a gate electrode coupled to the emission line ELj. The fifth transistor M5 and the sixth transistor M6 may be turned on in response to an emission signal EMj provided through the emission line ELj, and form a flow path of driving current between the first power voltage line and the fourth node N4 (or a second power voltage line to which a second power voltage VSS is applied).

The light emitting diode LD may include an anode electrode coupled to the fourth node N4 and a cathode electrode coupled to the second power voltage line. For example, the light emitting diode LD may be an organic light emitting diode or an inorganic light emitting diode. The light emitting diode LD may emit light with a luminance corresponding to a driving current (or an amount of driving current).

The seventh transistor M7 may include a first electrode coupled to the fourth node N4, a second electrode coupled to the initialization voltage line, and a gate electrode coupled to the gate line GLj. The seventh transistor M7 may initialize the fourth node N4 (or a parasitic capacitor of the light emitting diode LD) in response to the gate signal SCAN[j].

Figure 3:
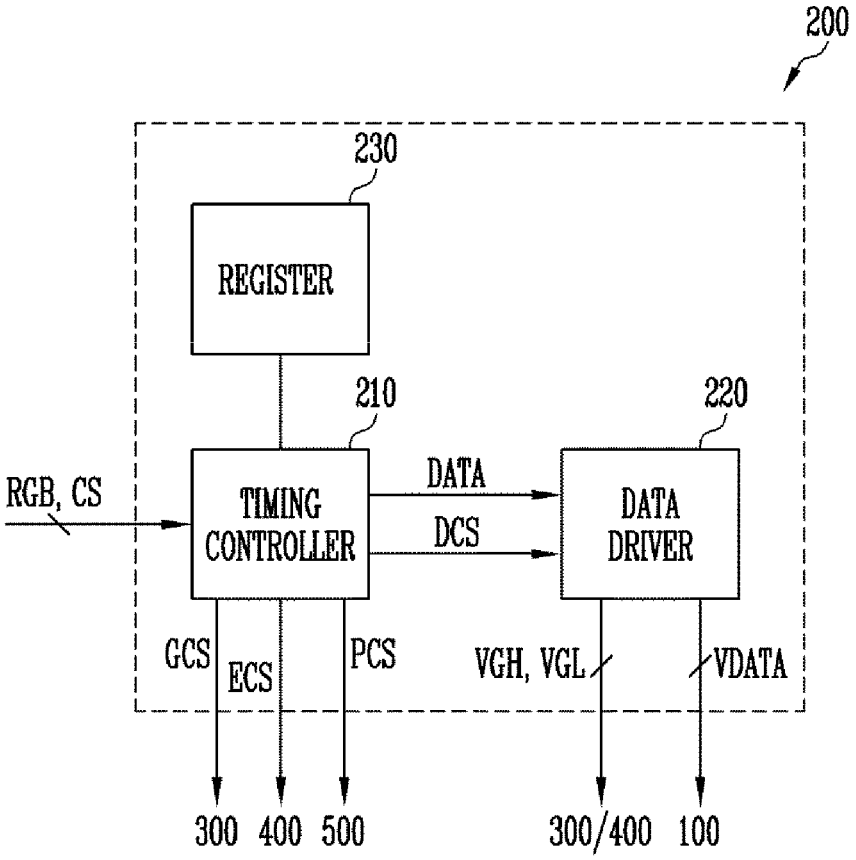
FIG. 3 is a block diagram illustrating an example of a data driver included in the display device shown in FIG. 1.
Figure 4:
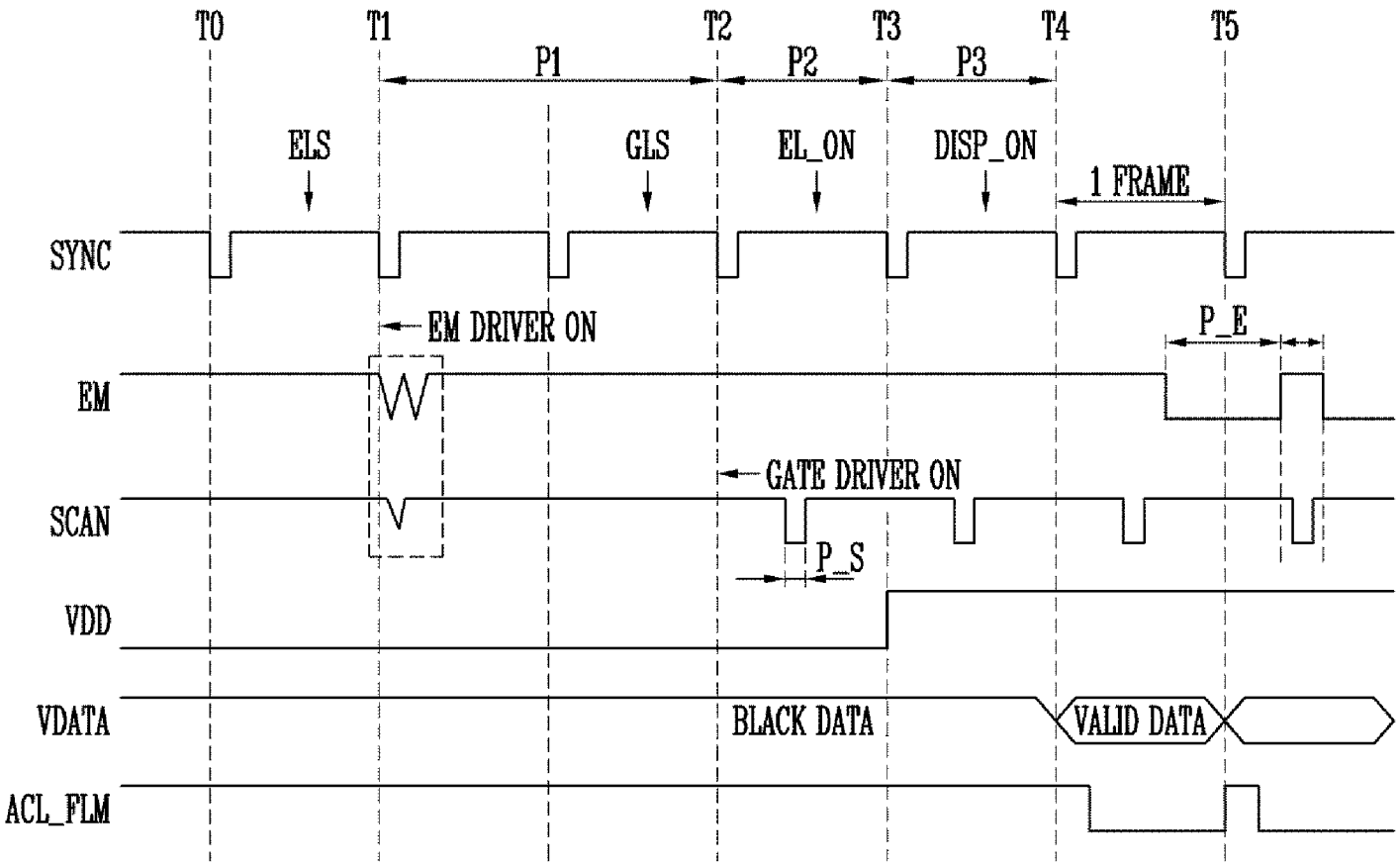
FIG. 4 is a waveform diagram illustrating an example of signals measured in the display device shown in FIG. 1.

FIG. 3 is a block diagram illustrating an example of a data driver included in the display device shown in FIG. 1. FIG. 4 is a waveform diagram illustrating an example of signals measured in the display device shown in FIG. 1.

Referring to FIGS. 1 and 3, the driver IC 200 may include a timing controller 210, a data driver 220, and a register (or memory device) 230.

As described with reference to FIG. 1, the timing controller 210 may receive input image data RGB and a control signal CS from the outside (e.g., a graphic processor), generate a gate control signal GCS, an emission control signal ECS, and a power control signal PCS, based on the control signal CS, and convert the input image data RGB into image data DATA corresponding to a pixel arrangement of the display panel 100 and then output the image data DATA. Also, the timing controller 210 may generate a data control signal DCS for controlling an operation of the data driver 220, based on the control signal CS. The data control signal DCS may include a horizontal start signal for starting an operation of the data driver 220, a load signal (or data enable signal) for instructing an output of a valid data signal, and the like.

The data driver 220 may receive the image data DATA and the data control signal DCS, and generate and output data signal VDATA corresponding to the image data DATA.

When the display device 1 is initially driven, the register 230 may store setting values that define an operation sequence (or power-up sequence) of the emission driver 400, the gate driver 300, and the power supplier 500 or operating time points of the emission driver 400, the gate driver 300, and the power supplier 500. For example, the setting values may include, based on a turn-on time point of the display device 1, a first setting value that defines a first operating time point at which the emission driver 400 starts an operation, a second setting value that defines a second operating time point at which the gate driver 300 starts an operation, and a third setting value that defines a third operating time point at which the power supplier 500 starts an operation. The second operating time point may be a time point posterior to (or later than) the first operating time point. The third operating time point may be a time point posterior to the first operating time point, and be equal or posterior to the second operating time point. Also, the setting values may further include a fourth setting value that defines a fourth operating time point at which the driver IC 200 (or the data driver 220) starts outputting a valid data signal. The fourth operating time point may be a time point posterior to the first to third operating time points.

In some embodiments, the timing controller 210 may sequentially generate an emission control signal (or emission enable signal) ECS, a gate control signal (or gate enable signal) GCS, and a power control signal (or power enable signal) PCS, based on the setting values. For example, the timing controller 210 may generate the emission control signal (or emission enable signal) ECS, based on the first setting value, generate the gate control signal (or gate enable signal) GCS, based on the second setting value, and generate the power control signal (or power enable signal) PCS, based on the third setting value. Also, the timing controller 210 may generate a data control signal (or display enable signal) DCS, based on the fourth setting value.

Referring to FIGS. 1, 3, and 4, a synchronization signal SYNC is a reference signal for determining operating periods of the emission driver 400, the gate driver 300, and the driver IC 200. For example, the synchronization signal SYNC may be a vertical synchronization signal. The synchronization signal SYNC may have a pulse form, and the period of the synchronization signal SYNC may correspond to one frame period 1 FRAME. An emission signal EM, a gate signal SCAN, a first power voltage VDD, and a data signal VDATA may be measured in the display panel 100 (or the pixel PX). An emission start signal ACL_FLM is included in the emission control signal ECS, and may be measured in the emission driver 400.

When the display device 1 is turned on at a reference time point T0, the driver IC 200 (or the timing controller 210)

may generate and output an emission enable signal ELS, based on the first setting value.

At a first time point T1, the emission driver 400 may be enabled or start an operation in response to the emission enable signal ELS. The first time point T1 may be a time point at which the level of the synchronization signal SYNC is changed from a logic high level to a logic low level after the emission enable signal ELS is output (i.e., a falling edge of the synchronization signal SYNC). The emission driver 400 may operate based on emission clock signals provided from the driver IC 200 together with the emission enable signal ELS.

However, the emission start signal ACL_FLM may have a logic high level (or turn-off voltage level). That is, the driver IC 200 may output the emission start signal ACL_FLM having the logic high level. Accordingly, the emission signal EM may have the logic high level at the first time point T1.

The emission driver 400 may maintain the emission signal EM to have the logic high level until before the emission start signal ACL_FLM having a logic low level (or turn-on voltage level) is received.

At the first time point T1, the gate signal SCAN may have the logic high level or a floating voltage level (i.e., a voltage level in a floating state), and the first power voltage VDD may have a ground voltage level or the floating voltage level. The data signal VDATA may have black data BLACK DATA (or invalid data) corresponding to a black image or a black voltage level. For example, the data signal VDATA may have a voltage level of about 7 volts (V).

That is, at the first time point T1, only the emission driver 400 may be driven, and the emission signal EM having the logic high level may be provided to the pixel PX, corresponding to the emission start signal ACL_FLM having the logic high level.

Meanwhile, as shown in FIG. 4, according to circuit characteristics of the emission driver 400 when the emission driver 400 is initially driven, noise may occurs in the emission signal EM during a certain period from the first time point T1, and the voltage level of the emission signal EM may be temporarily lowered. In addition, noise may partially occur even in the gate signal SCAN due to influence of the noise of the emission signal EM, but a change in the gate signal SCAN, which is caused by the noise with respect to the logic high level, may be insignificant.

Subsequently, in a first period P1, the driver IC 200 may generate and output a gate enable signal GLS, based on the second setting value.

At a second time point T2, the gate driver 300 may be enabled or start an operation in response to the gate enable signal GLS. The second time point T2 may be a time point when two frame periods elapse from the first time point T1, and accordingly, the length of the first period P1 may be longer than those of a second period P2 and a third period P3, which will be described later. In order to more surely eliminate that the noise occurring when the emission driver 400 is initially driven has influence on when the gate driver 300 is initially driven, the gate driver 300 may operate after two frame periods elapse after the emission driver 400 operates.

The gate driver 300 may operate based on a start signal and clock signals, which are provided from the driver IC 200, together with the gate enable signal GLS. The start signal may be a pulse signal having the logic low level (or turn-on voltage level). Accordingly, the gate signal SCAN having the logic low level may be periodically provided to the pixel PX.

At the second time point T2, the first power voltage VDD may be maintained to the ground voltage level, and the data signal VDATA may be maintained to the black voltage level. In the second period P2, the data signal VDATA may be stored in the pixel PX in response to the gate signal SCAN having the logic low level, but the pixel PX may not emit light according to a black data signal and the emission signal EM having the logic high level.

Subsequently, in the second period P2, the driver IC 200 may output a power enable signal EL_ON, based on the third setting value.

At a third time point T3, the power supplier 500 may provide the display panel 100 with the first power voltage VDD (and a second power voltage VSS) in response to the power enable signal EL_ON. The third time point T3 may be a time point when one frame period elapses from the second time point T2. Accordingly, the level of a first power voltage VDD measured in the display panel 100 at the third time point T3 may be changed from the ground voltage level to a first power voltage level.

Subsequently, the driver IC 200 may generate a display enable signal DISP_ON in the third period P3.

At a fourth time point T4, the driver IC 200 (or the data driver 220) may output a valid data signal in response to the display enable signal DISP_ON. The pixel PX may store a data signal VDATA in a period in which the gate signal SCAN has the logic low level. In addition, from after the fourth time point T4, the driver IC 200 may output the emission start signal ACL_FLM in a pulse form having the logic low level. The emission driver 400 may output the emission signal EM in a pulse form having the logic low level in response to the emission start signal ACL_FLM. The pixel PX may emit light with a luminance corresponding to the pre-stored data signal VDATA in a period in which the emission signal EM has the logic low level.

As described with reference to FIGS. 3 and 4, the driver IC 200 can sequentially drive the emission driver 400, the gate driver 300, and the power supplier 500, based on the pre-stored setting values, and then display an image. Further, the driver IC 200 drives the emission driver 400 earlier than the gate driver 300, and the emission start signal ACL_FLM is maintained to the logic high level for a certain time point. Thus, distortion of the gate signal SCAN due to noise occurring when the emission driver 400 is initially driven can be minimized or reduced, and deterioration of display quality can be prevented or reduced.

Figure 5:
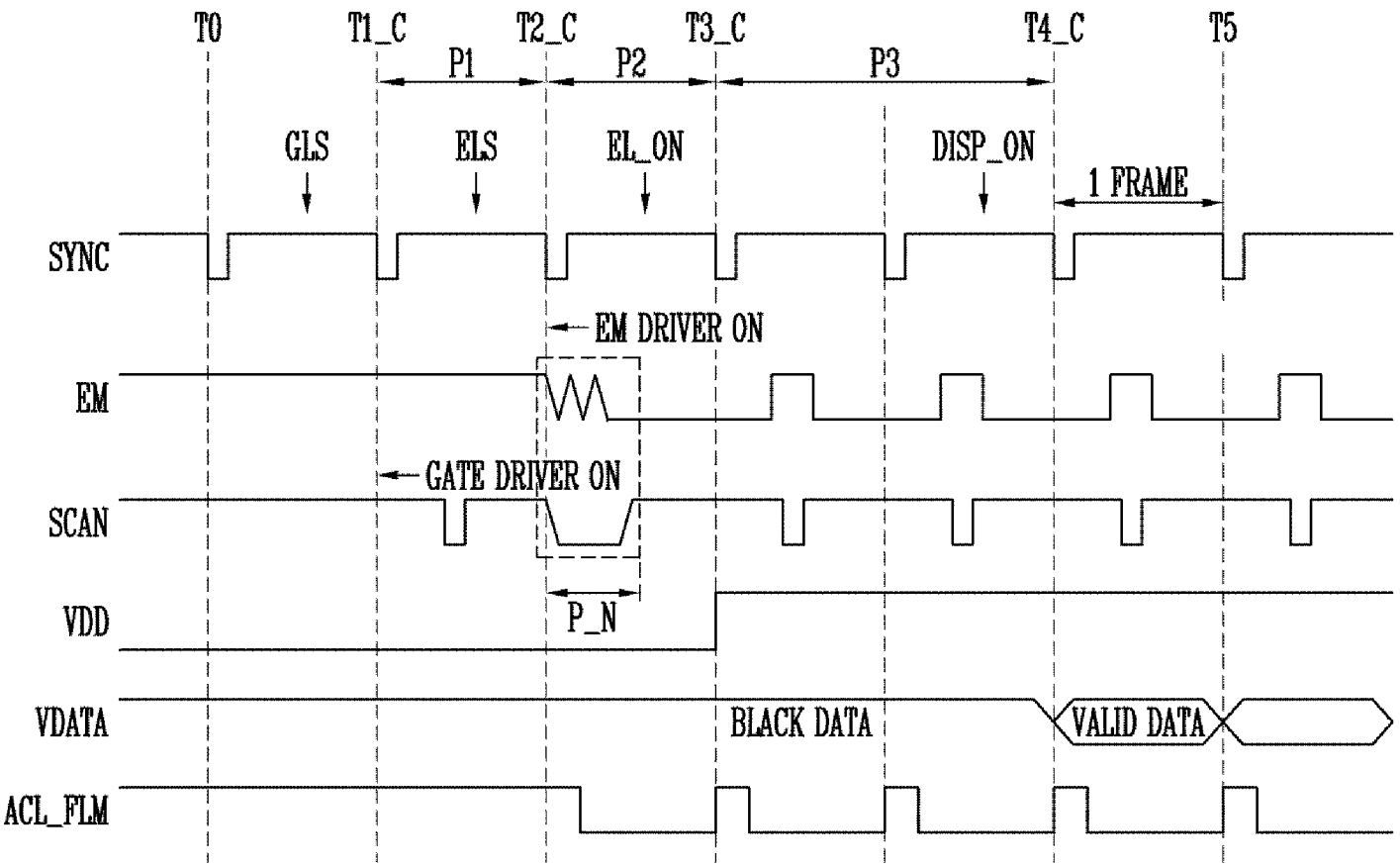
FIG. 5 is a waveform diagram illustrating a comparative example of the signals measured in the display device shown in FIG. 1.
Figure 6:
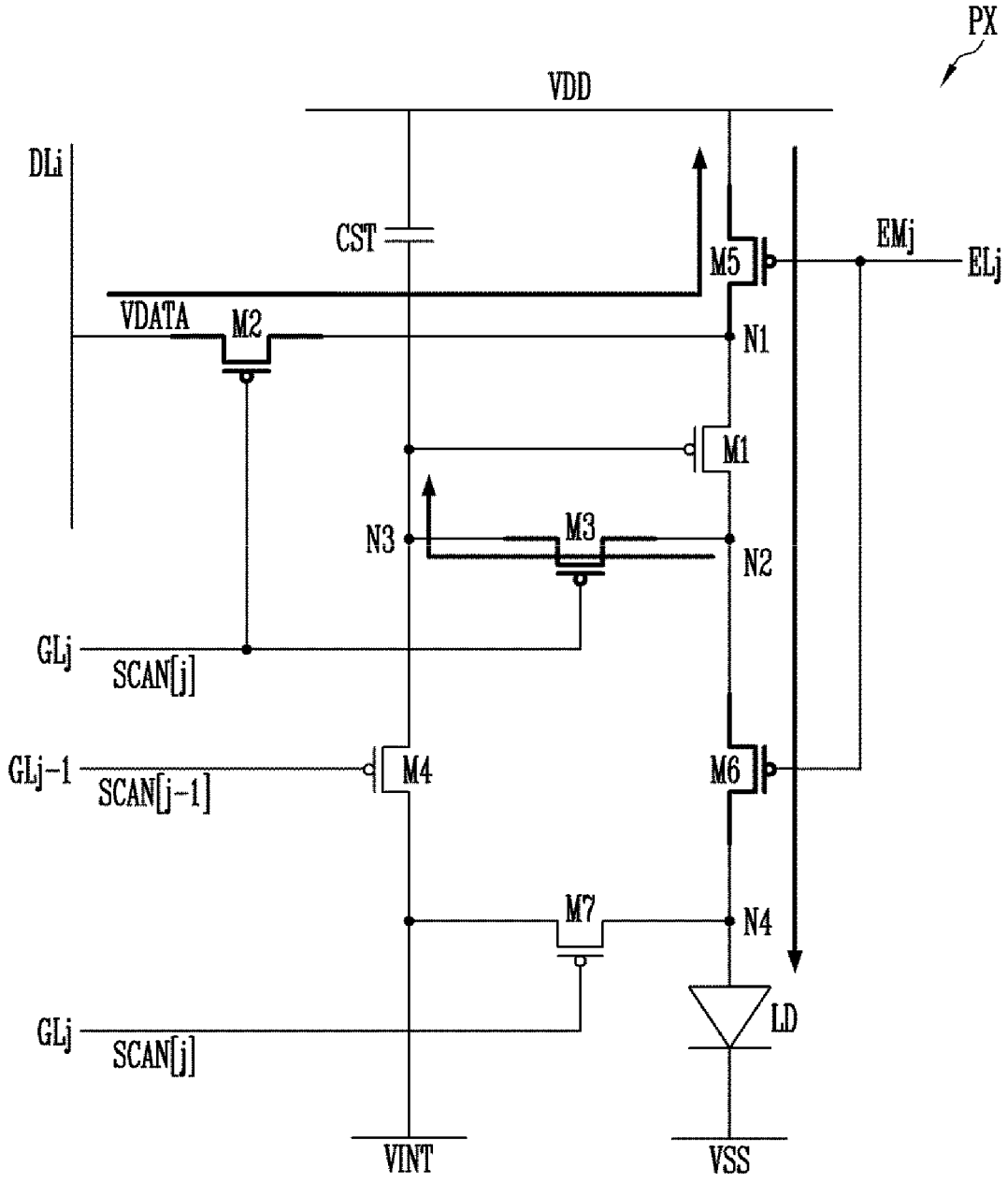
FIG. 6 is a diagram illustrating an operation of the pixel according to the measured signals shown in FIG. 5.

FIG. 5 is a waveform diagram illustrating a comparative example of the signals measured in the display device shown in FIG. 1. Signals corresponding to those shown in FIG. 4 are illustrated in FIG. 5. FIG. 6 is a diagram illustrating an operation of the pixel according to the measured signals shown in FIG. 5.

Referring to FIGS. 1, 5, and 6, at a reference time point T0, the display device 1 is turned on, and the driver IC 200 generates a gate enable signal GLS.

At a first comparison time point T1_C, the gate driver 300 starts operating in response to the gate enable signal GLS. Subsequently, a gate signal SCAN periodically has the logic low level.

Subsequently, the driver IC 200 generates an emission enable signal ELS. At a second comparison time point T2_C, the emission driver 400 starts operating in response to the emission enable signal ELS. An emission start signal ACL_FLM periodically has the logic low level, and an emission signal EM periodically has the logic low level, corresponding to the emission start signal ACL_FLM.

However, just after the second comparison time point T2_C, the voltage level of the emission signal EM temporarily has the logic low level due to noise when the emission driver 400 is initially driven, and consecutively to this, has the logic low level for a certain time, corresponding to the emission start signal ACL_FLM. Because the gate driver 300 that is operating is also influenced by the noise, the gate signal SCAN has the logic low level for a relatively long period. That is, both the emission signal EM and the gate signal SCAN have the logic low level during a noise period P_N.

As shown in FIG. 6, the second transistor M2 and the third transistor M3 are turned on in response to the gate signal SCAN[j] having the logic low level, the fifth transistor M5 and the sixth transistor M6 are turned on in response to the emission signal EMj having the logic low level, a black data signal provided through the data line DLi is applied to the first power voltage line through the second transistor M2 and the fifth transistor M5, and at least a portion of the black data signal (e.g., a data signal having a voltage level lower than that of the black data signal due to leakage) is transferred and stored in the storage capacitor CST through the first transistor M1 and the third transistor M3. In addition, the black data signal may serve as a power voltage. Subsequently, during a period in which the emission signal EM shown in FIG. 5 has the logic low level (i.e., the whole of a second period P2), a driving current flows through the fifth transistor M5 and the sixth transistor M6, and the light emitting diode LD emits light, corresponding to the driving current. That is, an unintended image is displayed in a first period P1.

Signals after the second period P2 are similar to those described with reference to FIG. 4, and their overlapping descriptions will be omitted.

As described with reference to FIGS. 5 and 6, when the gate driver 300 starts an operation earlier than that of the emission driver 400, malfunction of the gate driver 300 occurs due to noise occurring when the emission driver 400 starts operating, and a temporal display failure such as blinking may occur.

Thus, in the display device 1 according to some example embodiments of the present disclosure, the emission driver 400 is driven earlier than the gate driver 300, and the emission start signal ACL_FLM is maintained to the logic high level for a certain time, so that incidences of a display failure occurring when the display device 1 is initially driven can be prevented or reduced.

FIGS. 7 to 15 are waveform diagrams illustrating various examples of the signals measured in the display device shown in FIG. 1. Signals corresponding to those shown in FIG. 4 are illustrated in FIGS. 7 to 15.

Figure 7:
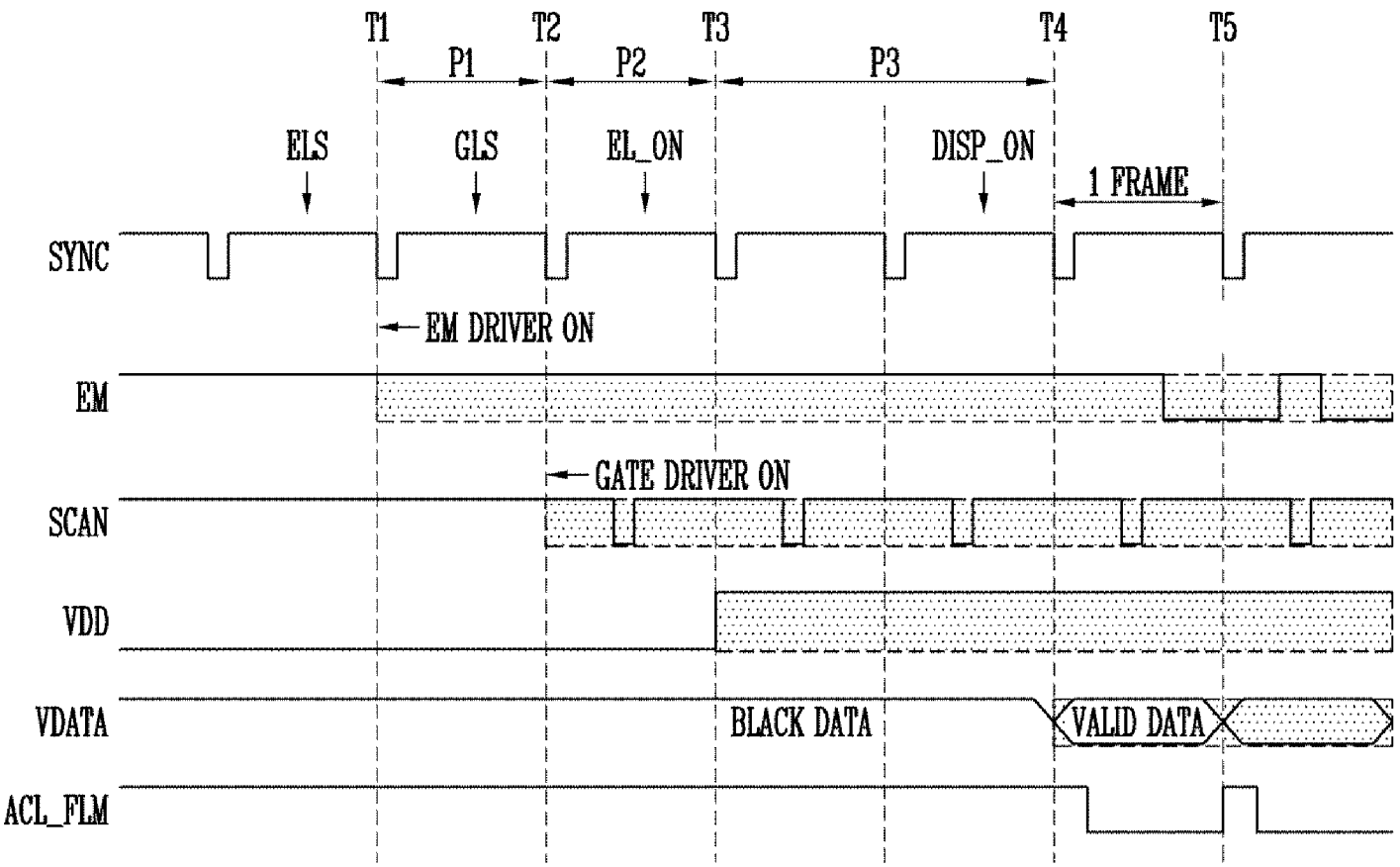
FIGS. 7 to 15 are waveform diagrams illustrating various examples of the signals measured in the display device shown in FIG. 1.

First, referring to FIGS. 4 and 7, the first period P1 (i.e., the period from the time point at which the emission driver 400 operates to the time point at which the gate driver 300 starts operating) shown in FIG. 4 may be longer than the second period P2 (i.e., the period from the time point at which the gate driver 300 starts operating to the time point at which the first power voltage VDD starts being applied to the display panel 100) and the third period P3 (i.e., valid data starts being applied after the first power voltage VDD is applied), which are shown in FIG. 4. A first period P1 shown in FIG. 7 may have the same length as a second period P2 shown in FIG. 7, and be shorter than a third period P3 shown in FIG. 7.

The driver IC 200 may sequentially output an emission enable signal ELS, a gate enable signal GLS, and a power enable signal EL_ON at an interval of one frame period, and the emission driver 400, the gate driver 300, and the power supplier 500, which are described with reference to FIG. 1, may be sequentially enabled at an interval of one frame period or start operating in response to the emission enable signal ELS, the gate enable signal GLS, and the power enable signal EL_ON.

At a fourth time point T4 when two frame periods elapse from a third time point T3 at which the power supplier 500 supplies a first power voltage VDD to the display panel 100, the driver IC 200 may provide a valid data signal to the display panel 100 in response to a display enable signal DISP_ON.

For example, when the power supplier 500 gradually increases the first power voltage VDD, using a soft start function for preventing an inrush current from being applied to the display panel 100, the display device 1 may display an image after the first power voltage VDD is stabilized.

Meanwhile, although a case where the first period P1 is shorter than the third period P3 is illustrated in FIG. 7, the present disclosure is not limited thereto. For example, the first period P1 may be longer than the second period P2, and have the same length as the third period P3.

Figure 8:
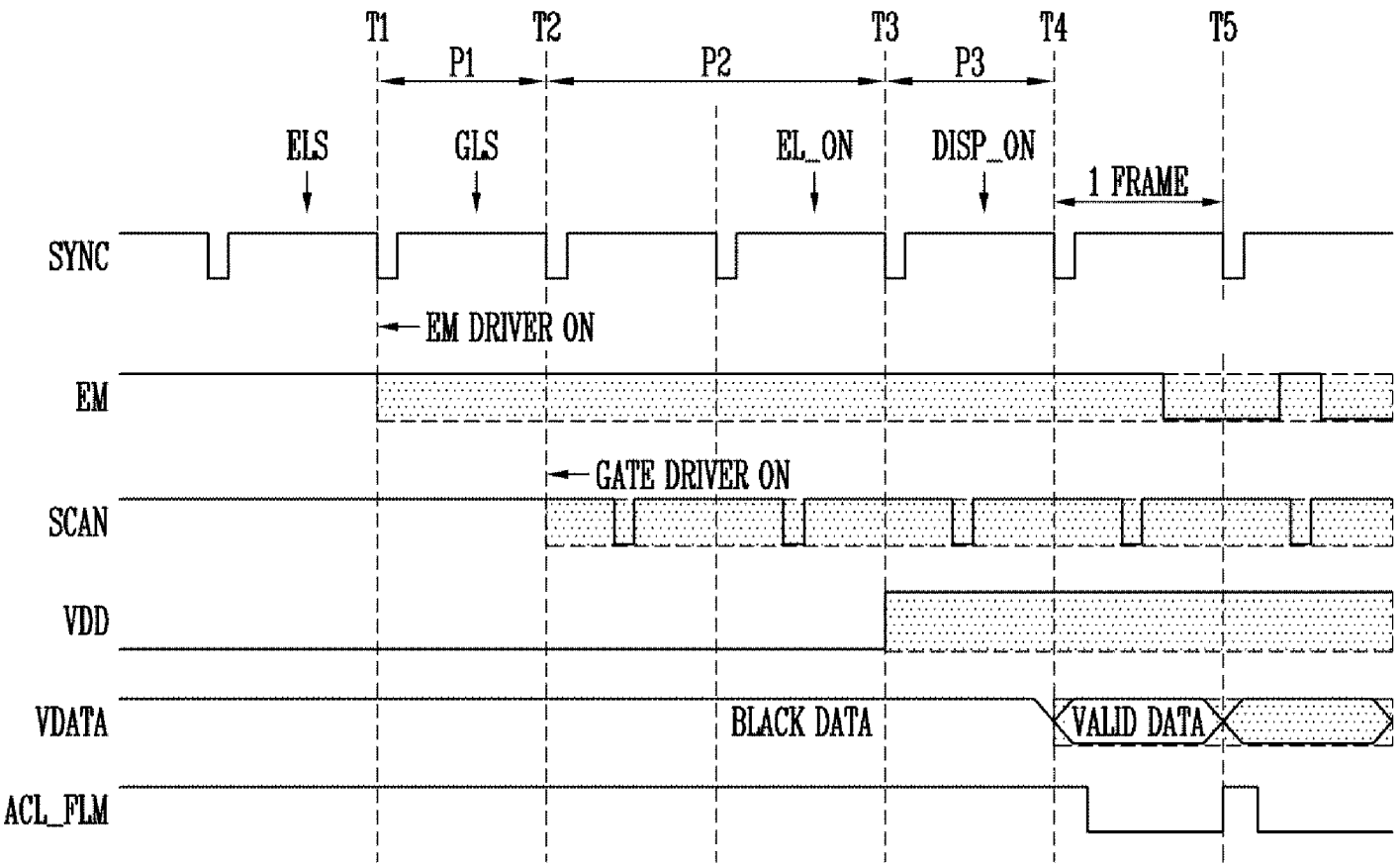

Referring to FIGS. 7 and 8, signals shown in FIG. 8 are different from those shown in FIG. 7 in that a first period P1 shown in FIG. 8 has the same length as a third period P3 shown in FIG. 8 and is shorter than a second period P2 shown in FIG. 8.

The gate driver 300 may start operating at a time point when one frame period elapses after the emission driver 400 starts operating, and the power supplier 500 may supply a first power voltage VDD to the display panel 100 at a time point when two frame periods elapse after the gate driver 300 is driven.

Figure 9:
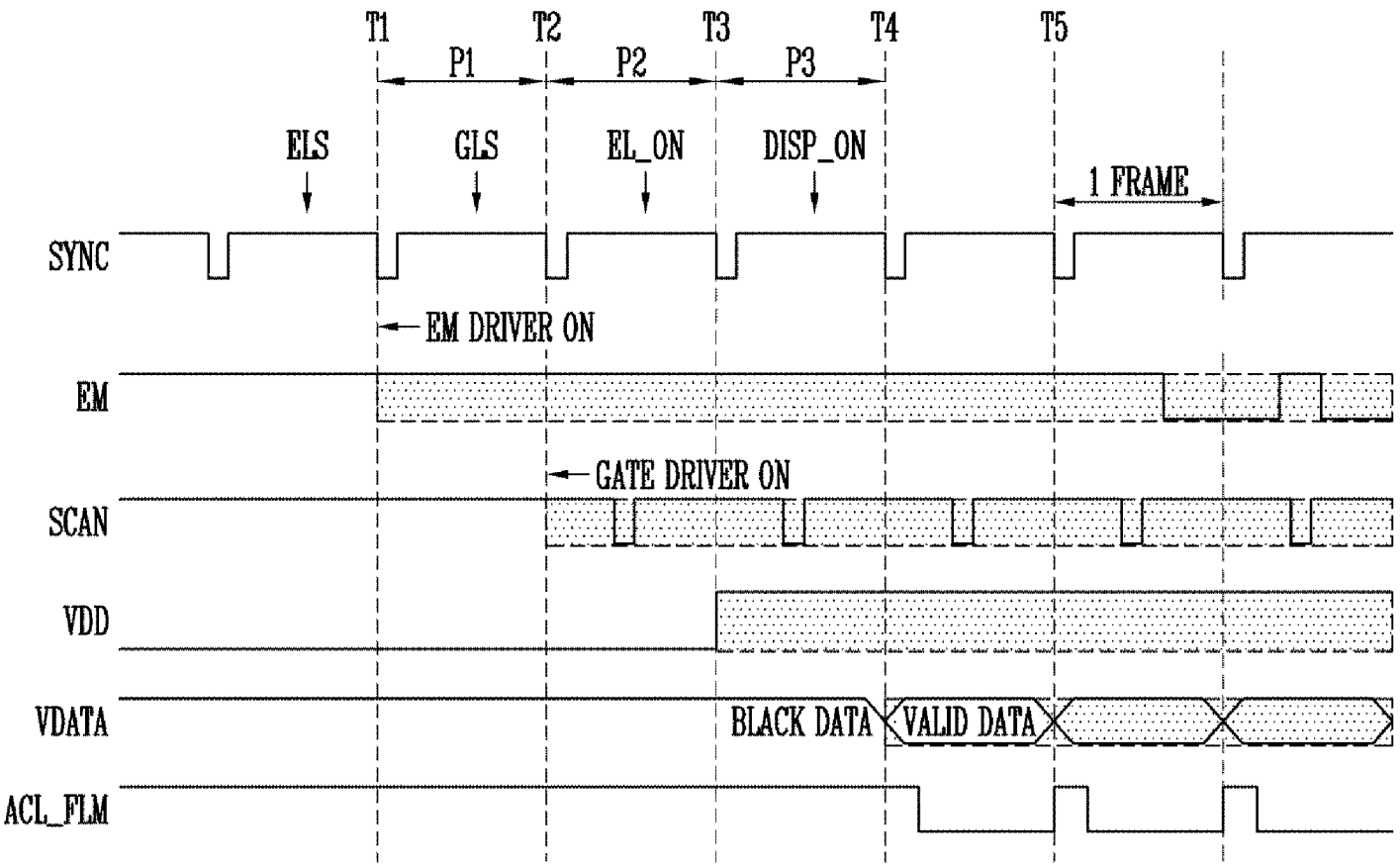

Referring to FIGS. 7 and 9, signals shown in FIG. 9 are different from those shown in FIG. 7 in that a first period P1, a second period P2, and a third period P3, which are shown in FIG. 9, have the same length.

The gate driver 300 may start operating at a time point when one frame period elapses after the emission driver 400 starts operating, the power supplier 500 may supply a first power voltage VDD to the display panel 100 at a time point when one frame period elapses after the gate driver 300 is driven, and a valid data signal may be provided to the display panel 100 at a time point when one frame period elapses after the first power voltage VDD is supplied.

As the emission driver 400, the gate driver 300, the power supplier 500, and the driver IC 200 are sequentially driven, power consumption can be dispersed, and the preparation time until an image is displayed can be reduced while avoiding interference between the emission driver 400, the gate driver 300, the power supplier 500, and the driver IC 200.

Referring to FIGS. 7 and 10 to 14, signals shown in each of FIGS. 10 to 14 are different from those shown in FIG. 7 in that a second time point T2 (i.e., a time point at which the gate driver 300 starts operating) shown in each of FIGS. 10 to 14 is the same as a third time point T3 (i.e., a time point at which the power supplier 500 provides a first power voltage VDD to the display panel 100) shown in each of FIGS. 10 to 14.

Figure 10:
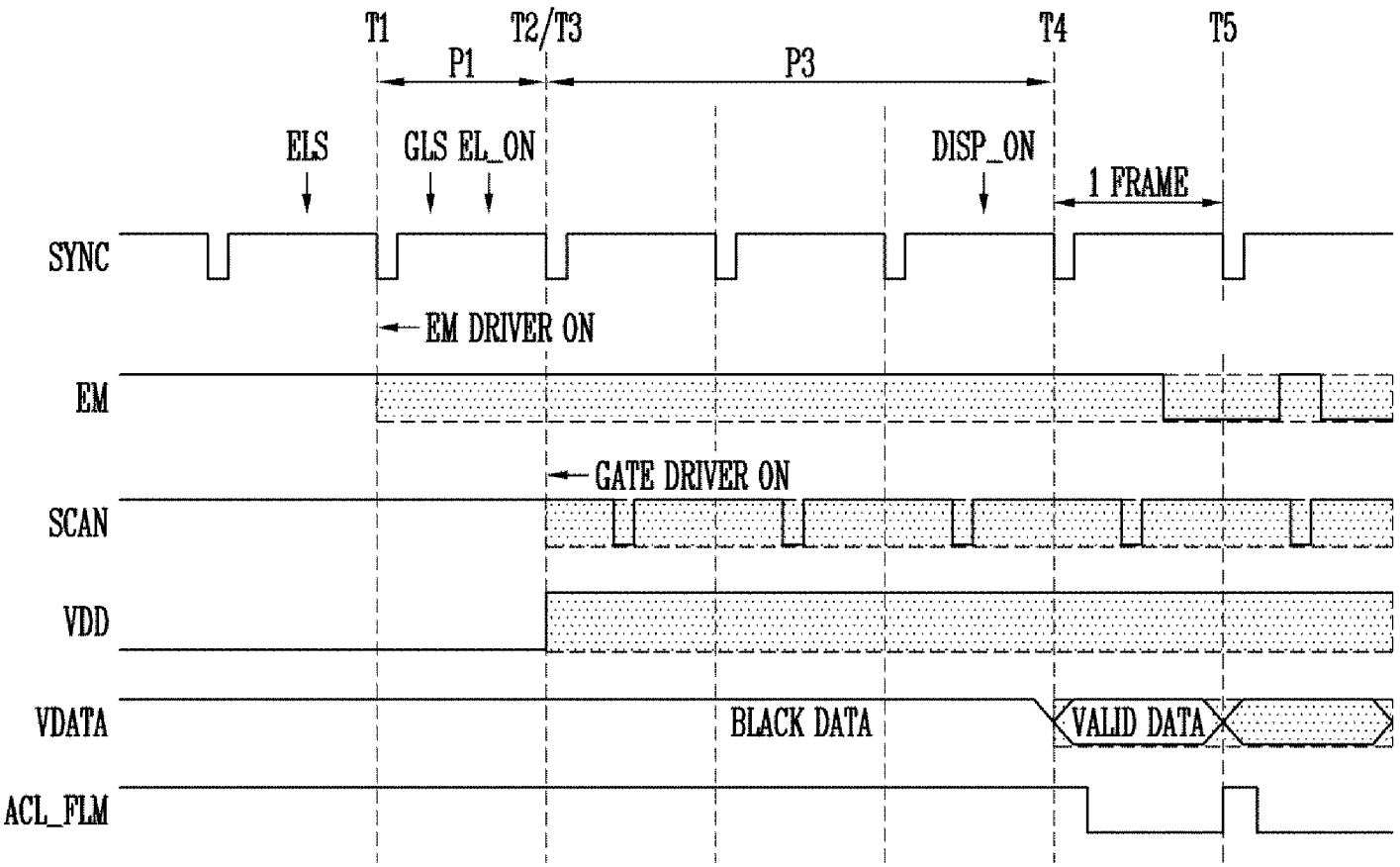

According to the signals shown in FIG. 10, the gate driver 300 may start operating and simultaneously, the power supplier 500 may supply a first power voltage VDD to the display panel 100 at a time point when one frame period after the emission driver 400 starts operating, and a valid data signal may be provided to the display panel 100 at a time point when three frame periods elapse after the first power voltage VDD is supplied. Thus, a sufficient time required to stabilize the first power voltage VDD can be secured.

Figure 11:
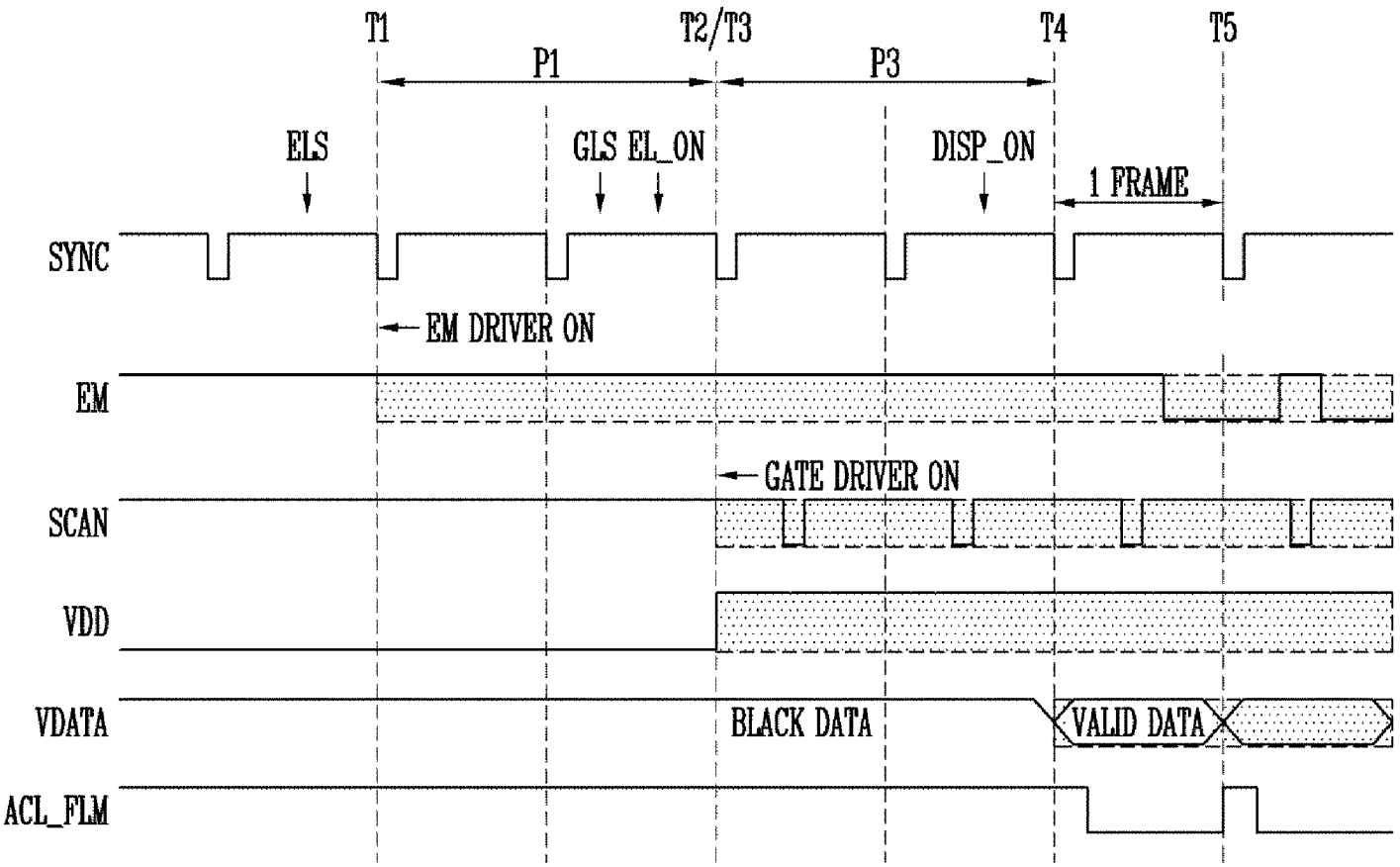

According to the signals shown in FIG. 11, the gate driver 300 may start operating and simultaneously, the power supplier 500 may supply a first power voltage VDD to the display panel 100 at a time point when two frame periods elapse after the emission driver 400 starts operating, and a valid data signal may be provided to the display panel 100 at a time point when two frame periods elapse after the first power voltage VDD is supplied. Thus, that noise occurring when the emission driver 400 is initially driven has influence on when the gate driver 300 is initially driven can be more surely eliminated. Further, a sufficient time required to stabilize the first power voltage VDD can be secured.

Figure 12:
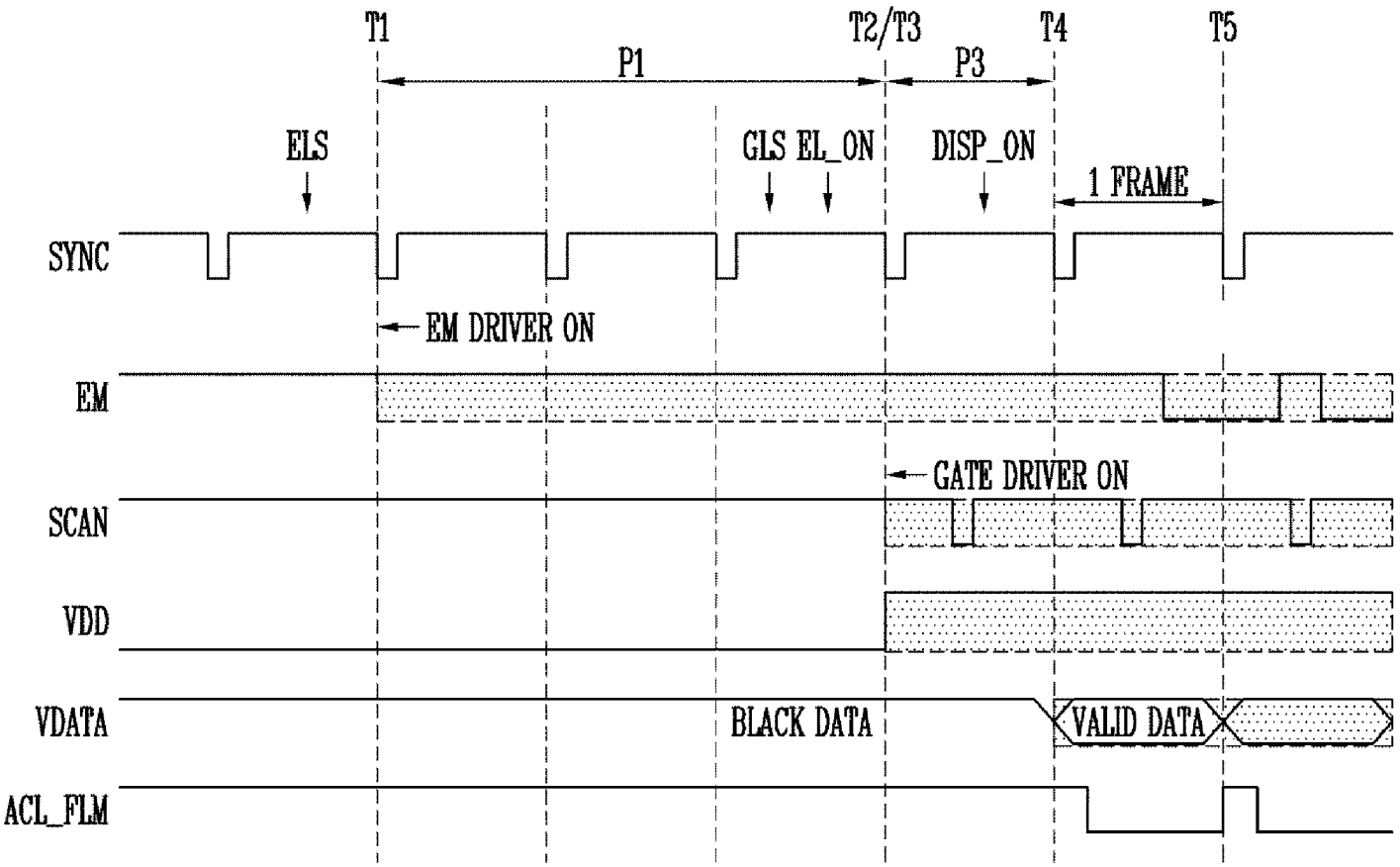

According to the signals shown in FIG. 12, the gate driver 300 may start operating and simultaneously, the power supplier 500 may supply a first power voltage VDD to the display panel 100 at a time point when three frame periods elapse after the emission driver 400 starts operating, and a valid data signal may be provided to the display panel 100 at a time point when one frame period elapses after the first power voltage VDD is supplied.

Figure 13:
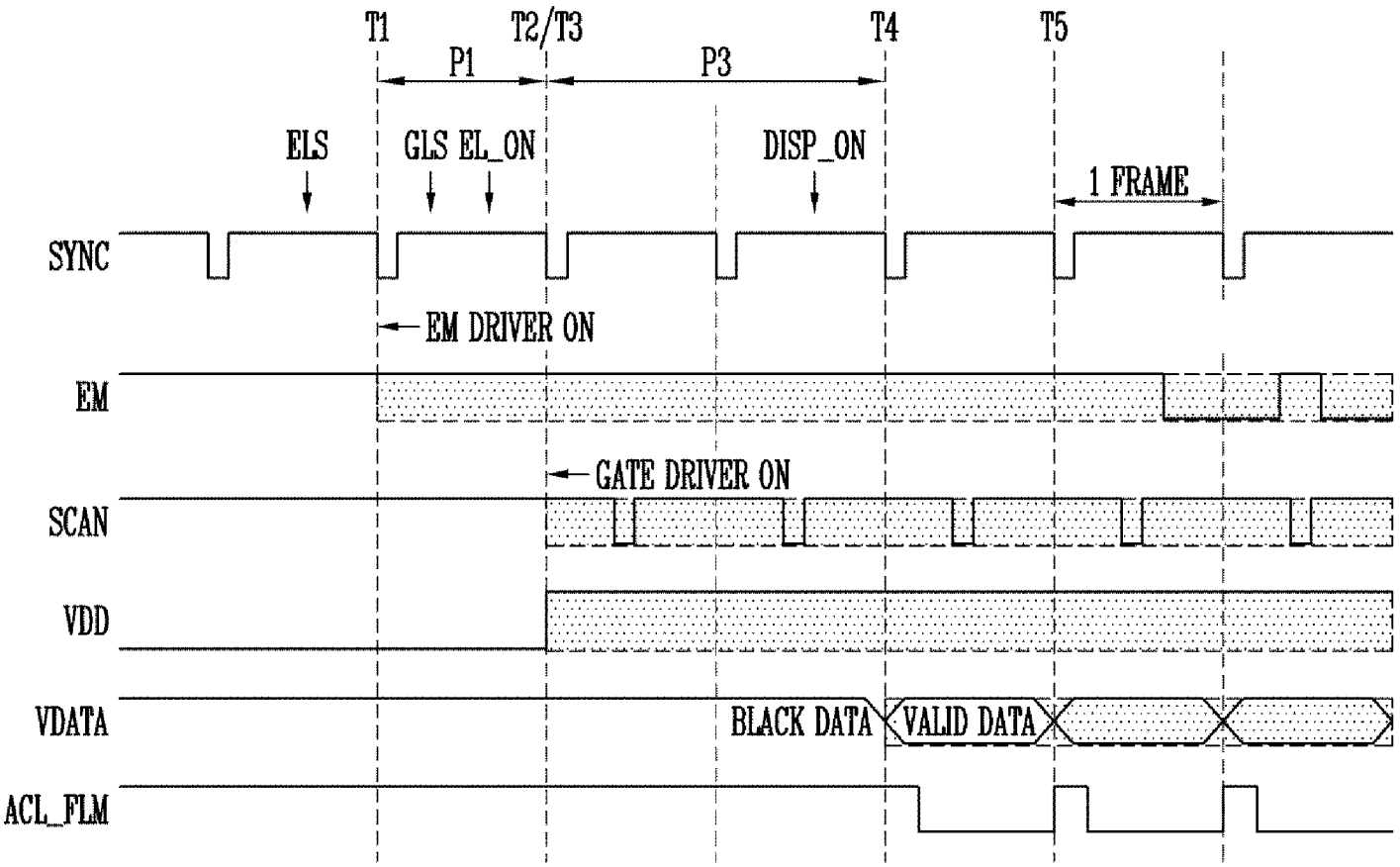

According to the signals shown in FIG. 13, the gate driver 300 may start operating and simultaneously, the power supplier 500 may supply a first power voltage VDD to the display panel 100 at a time point when one frame period elapses after the emission driver 400 starts operating, and a valid data signal may be provided to the display panel 100 at a time point when two frame periods elapse after the first power voltage VDD is supplied. Thus, the preparation time until an image is displayed can be reduced.

Figure 14:
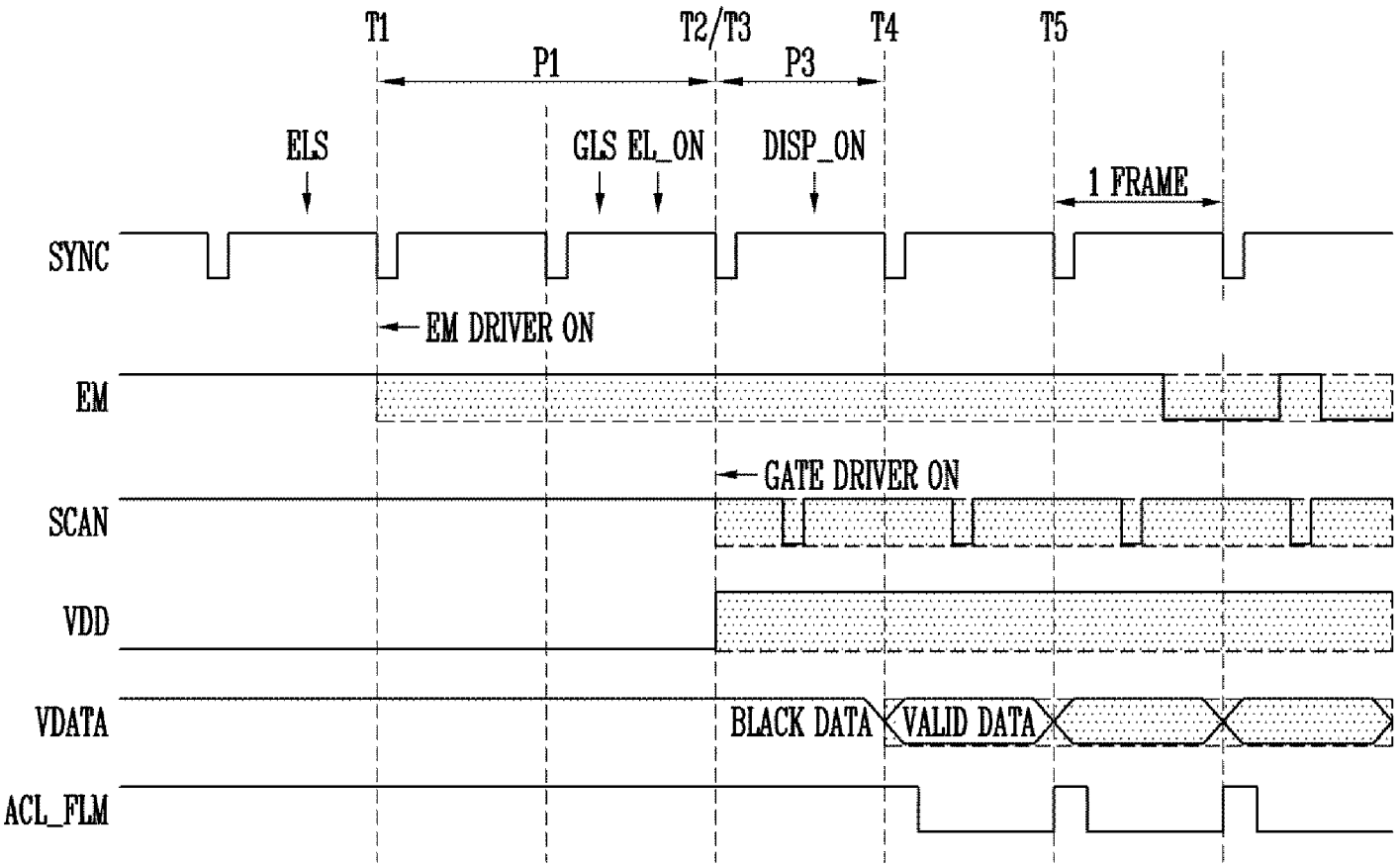

According to the signals shown in FIG. 14, the gate driver 300 may start operating and simultaneously, the power supplier 500 may supply a first power voltage VDD to the display panel 100 at a time point when two frame periods elapse after the emission driver 400 starts operating, and a valid data signal may be provided to the display panel 100 at a time point when one frame period elapses after the first power voltage VDD is supplied.

Figure 15:
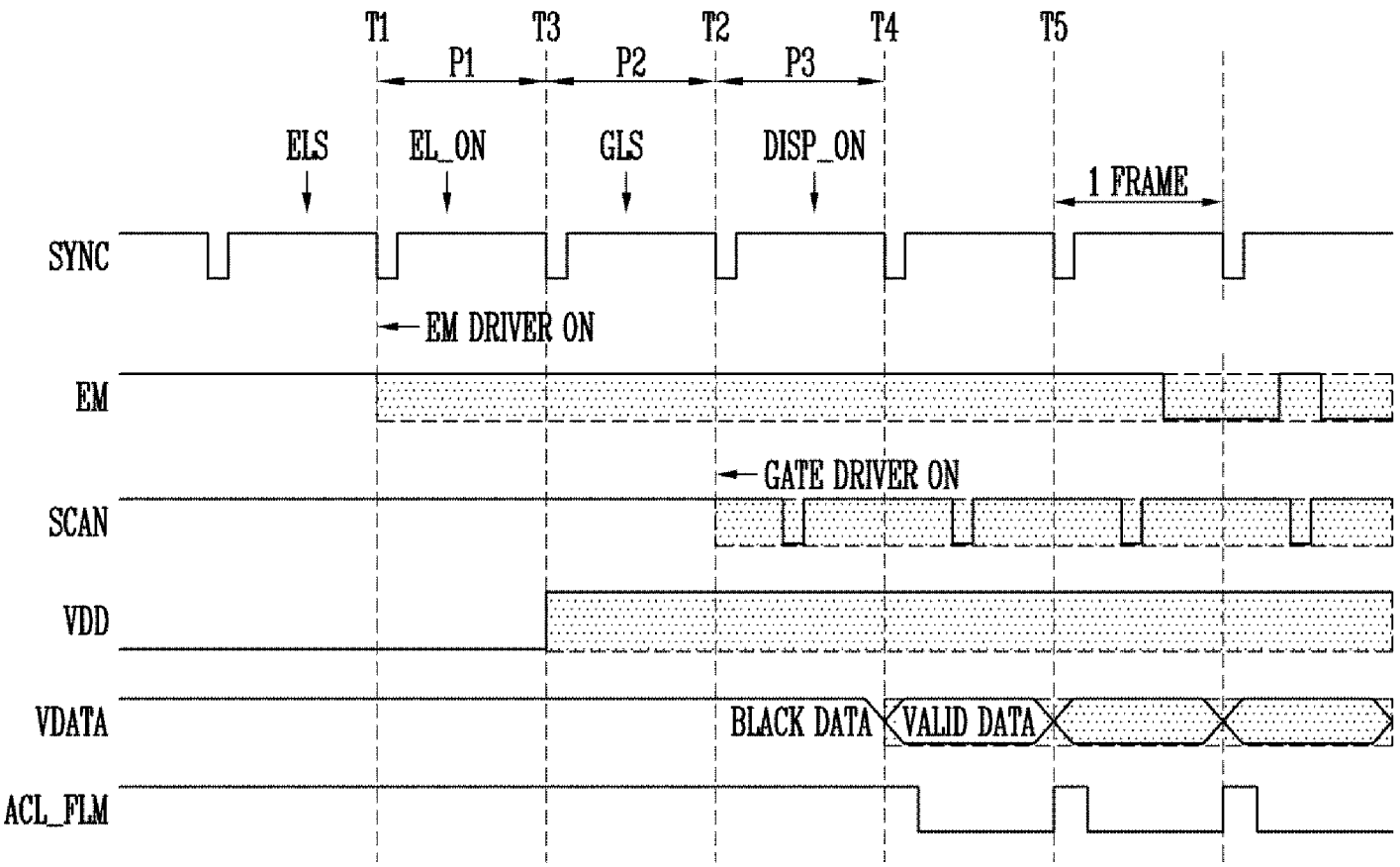

Referring to FIGS. 14 and 15, signals shown in FIG. 15 are different from those shown in FIG. 14 in that a second time point T2 (i.e., a time point at which the gate driver 300 starts operating) shown in FIG. 15 is a time point posterior to a third time point T3 (i.e., a time point at which the power supplier 500 provides a first power voltage VDD to the display panel 100).

According to the signals shown in FIG. 15, the power supplier 500 may supply the first power voltage VDD to the display panel 100 at a time point when one frame period elapses after the emission driver 400 starts operating, the gate driver 300 may start operating at a time point when one frame period elapses after the first power voltage VDD is supplied, and a valid data signal may be provided to the display panel 100 at a time point when one frame period elapses after the gate driver 300 is driven. As the emission driver 400, the gate driver 300, the power supplier 500, and the driver IC 200 are sequentially driven, power consumption can be dispersed, and that noise occurring when the emission driver 400 is initially driven has influence on when the gate driver 300 is initially driven can be more surely eliminated while avoiding interference between the emission driver 400, the gate driver 300, the power supplier 500, and the driver IC 200. Further, a sufficient time required to stabilize the first power voltage VDD can be secured.

Figure 16:
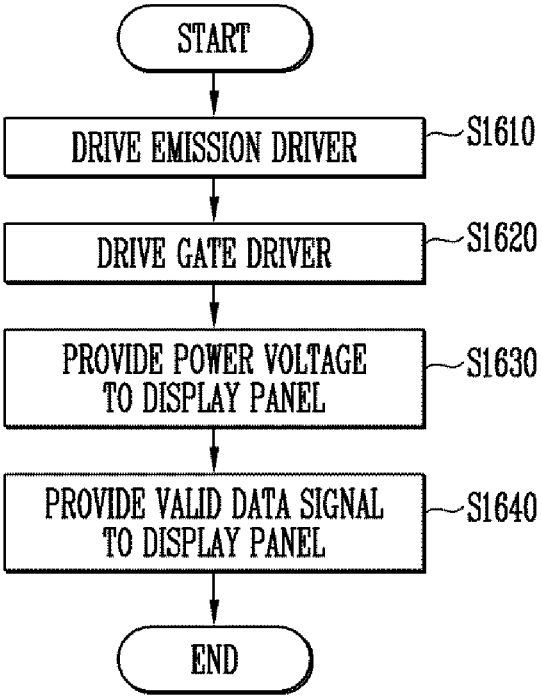
FIG. 16 is a flowchart illustrating a method for driving the display device according to some example embodiments of the present disclosure.

FIG. 16 is a flowchart illustrating a method for driving the display device according to some example embodiments of the present disclosure.

Referring to FIGS. 1 and 16, the method shown in FIG. 16 may be performed in the display device 1 shown in FIG. 1.

The method shown in FIG. 16 may provide an emission signal EM having a first voltage level to the pixel PX in the display panel 100 by driving the emission driver 400 (S1610).

As described with reference to FIG. 4, the method shown in FIG. 16 may provide an emission enable signal ELS to the emission driver 400 from the driver IC 200, and the emission driver 400 may be enabled or start operating in response to the emission enable signal ELS.

As described with reference to FIG. 4, when an emission start signal ACL_FLM is maintained to the first voltage level (or logic high level or turn-off voltage level), the emission signal EM may have the first voltage level.

Subsequently, the method shown in FIG. 16 may periodically provide a gate signal SCAN having a second voltage level to the pixel PX by driving the gate driver 300 (S1620).

As described with reference to FIG. 4, the method shown in FIG. 16 may provide a gate enable signal GLS to the gate driver 300 from the driver IC 200, and the gate driver 300 may be enabled or start operating in response to the gate enable signal GLS. The time point at which the gate driver 300 operates may be a time point after one frame, two frames or three frames from the time point at which the emission driver 400 operates as described with reference to FIGS. 4, 7, 12, and the like.

Subsequently, the method shown in FIG. 16 may provide a first power voltage VDD (and a second power voltage VSS) to the display panel 100 from the power supplier 500 (S1630).

As described with reference to FIG. 4, the method shown in FIG. 16 may provide a power enable signal EL_ON to the power supplier 500 from the driver IC 200, and the power supplier 500 may be enabled or start operating in response to the power enable signal EL_ON. The time point at which the power supplier 500 operates may be a time point after one frame or two frames from the time point at which the gate driver 300 operates, or be the same as the time point at which the gate driver 300 operates, as described with reference to FIGS. 4, 7, 10, and the like. However, the present disclosure is not limited thereto, and the power supplier 500 may operate before the gate driver 300 operates as described with reference to FIG. 15.

Subsequently, the method shown in FIG. 16 may provide a valid data signal to the display panel 100 from the driver IC 200 (S1640). As described with reference to FIG. 4, in the method shown in FIG. 16, the driver IC 200 may generate a display enable signal DISP_ON. The driver IC 200 (or the data driver 220 described with reference to FIG. 3) may provide a valid data signal to the display panel 100 in response to the display enable signal DISP_ON.

Meanwhile, as described above, the driver IC 200 may provide the display panel 100 with an invalid data signal (or black data signal) corresponding to a black image before the valid data signal is provided to the display panel 100 (i.e., while the emission driver 400, the gate driver 300, and the power supplier 500 are being driven). Thus, deterioration of display quality (e.g., blinking of a screen) when the display device 1 is initially driven can be prevented or reduced.

According to the present disclosure, the emission driver is driven earlier than the gate driver, so that occurrence of noise in a gate signal due to the emission driver can be minimized or reduced, and deterioration of display device such as blinking of a screen can be prevented or reduced.

Aspects of some example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, and their equivalents.

What is claimed is:

1. A display device comprising:

a display panel including a gate line, an emission signal line, a data line, and a pixel coupled to the gate line, the emission signal line, and the data line;

a gate driver configured to provide a gate signal to the gate line;

an emission driver configured to provide an emission signal to the emission signal line;

a data driver configured to provide a data signal to the data line; and a power supplier configured to provide the display panel with a power voltage for driving the pixel, wherein the emission driver is configured to start operating at a first time point in response to an emission enable signal provided from the data driver, and the gate driver is configured to start operating at a second time point in response to a gate enable signal provided from the data driver, and wherein the second time point is later than the first time point.

2. The display device of claim 1, wherein the display panel includes a display area configured to display an image and a non-display area adjacent to an edge of the display area, wherein the emission driver is in the non-display area, and wherein the gate driver is between the emission driver and the display area.

3. The display device of claim 1, wherein the display panel further includes a first power line and a second power line, wherein the pixel includes:

a first transistor including a first electrode coupled to a first node, a second electrode coupled to a second node, and a gate electrode coupled to a third node;

a second transistor including a first electrode coupled to the data line, a second electrode coupled to the first node, and a gate electrode coupled to the gate line;

a third transistor including a first electrode coupled to the second node, a second electrode coupled to the third node, and a gate electrode coupled to the gate line;

a fourth transistor including a first electrode coupled to the first power line, a second electrode coupled to the first node, and a gate electrode coupled to the emission signal line;

a capacitor coupled between the first power line and the third node; and a light emitting element coupled between the second node and the second power line.

4. The display device of claim 1, wherein the data driver includes:

a register configured to store a first setting value defining the first time point and a second setting value defining the second time point; and a signal controller configured to generate the emission enable signal and the gate enable signal, based on the first setting value and the second setting value.

5. The display device of claim 1, wherein the power supplier is configured to provide the power voltage to the display panel at a third time point in response to a power enable signal provided to the data driver, wherein the third time point is later than the first time point.

6. The display device of claim 5, wherein the data driver is configured to provide the data line with a black data signal corresponding to a black image at the first time point and the second time point, and to provide the data line with a valid data signal different from the black data signal at a fourth time point, wherein the fourth time point is later than the first to third time points.

7. The display device of claim 6, wherein the data driver is configured to provide an emission start signal having a first voltage level to the emission driver in a first period between the first time point and the fourth time point, and to periodically provide an emission start signal having a second voltage level in a second period after the fourth time point, wherein the emission driver is configured to provide the emission signal line with an emission signal having a waveform corresponding to a waveform of the emission start signal, wherein the pixel is configured to emit light with a luminance corresponding to the data signal in response to the emission signal.

8. The display device of claim 7, wherein the third time point is a time later than the second time point.

9. The display device of claim 8, wherein a first sub-period between the first time point and the second time point is longer than a second sub-period between the second time point and the third time point.

10. The display device of claim 8, wherein a first sub-period between the first time point and the second time point has a same length as a second sub-period between the second time point and the third time point, wherein a third sub-period between the third time point and the fourth time point is longer than the first sub-period between the second time point and the third time point.

11. The display device of claim 8, wherein a second sub-period between the second time point and the third time point is longer than a first sub-period between the first time point and the second time point.

12. The display device of claim 8, wherein a first sub-period between the first time point and the second time point, a second sub-period between the second time point and the third time point, and a third sub-period between the third time point and the fourth time point have a same length.

13. The display device of claim 7, wherein the third time point is the same as the second time point.

14. The display device of claim 13, wherein a first sub-period between the first time point and the second time point is shorter than a second sub-period between the third time point and the fourth time point.

15. The display device of claim 13, wherein a first sub-period between the first time point and the second time point has a same length as a second sub-period between the third time point and the fourth time point.

16. The display device of claim 13, wherein a first sub-period between the first time point and the second time point is longer than a second sub-period between the third time point and the fourth time point.

17. The display device of claim 13, wherein the third time point is between the first time point and the second time point.

18. A method for driving a display device, the method comprising:

providing, by an emission driver, an emission signal having a first voltage level to a pixel in a display panel;

providing, by a gate driver, a gate signal periodically having a second voltage level to the pixel by driving the gate driver;

providing, by a data driver, a valid data signal to the display panel; and periodically changing, by the emission driver, the emission signal to have the second voltage level, and providing the emission signal having the second voltage level to the pixel, wherein the emission driver is configured to start operating at a first time point in response to an emission enable signal provided from the data driver, and the gate driver is configured to start operating at a second time point in response to a gate enable signal provided from the data driver.

19. The method of claim 18, further comprising, before the providing of the valid data signal, providing, by a power supplier, a power voltage to the display panel.

20. The method of claim 19, wherein the data driver is configured to provide the display panel with a black data signal corresponding to a black image before the valid data signal is provided to the display panel.

* * * * *